United States Patent [19]

Sloan et al.

[11] Patent Number: 4,854,058

[45] **Date of Patent: * Aug. 8, 1989**

[54] DREDGING APPARATUS HAVING A DIVER-OPERATED HAND-HELD DREDGE HEAD FOR QUASI-CLOSED LOOP SYSTEM

[75] Inventors: Owen K. Sloan; Albert H. Sloan, both of Ft. Lauderdale, Fla.

[73] Assignee: Sloan Pump Company, Inc., Ft. Lauderdale, Fla.

[ * ] Notice: The portion of the term of this patent subsequent to Feb. 28, 2006 has been disclaimed.

[21] Appl. No.: 208,474

[22] Filed: Jun. 20, 1988

Related U.S. Application Data

[63] Continuation-in-part of Ser. No. 47,220, May 8, 1987, Pat. No. 4,807,373.

[51] Int. Cl.[4] ..... E02F 3/88

[52] U.S. Cl. ..... 37/63; 37/58; 210/170; 210/237; 210/241

[58] Field of Search ..... 37/58–63, 37/195; 210/237, 241, 258, 170, 712

[56] References Cited

U.S. PATENT DOCUMENTS

| | | | |
|---|---|---|---|
| 1,611,478 | 12/1926 | Massey | 37/58 |
| 3,631,997 | 1/1972 | De Konig | 37/58 X |
| 3,964,184 | 6/1976 | Mathieu | 37/63 X |
| 3,975,842 | 8/1976 | Andreae | 37/63 X |
| 4,053,181 | 10/1977 | Saito | 37/58 X |
| 4,079,003 | 3/1978 | Manchak | 210/712 |
| 4,352,251 | 10/1982 | Sloan | 37/58 |
| 4,409,746 | 10/1983 | Beck | 37/58 |
| 4,801,376 | 1/1989 | Kulitz | 210/241 |
| 4,807,373 | 2/1989 | Sloan et al. | 37/63 |

FOREIGN PATENT DOCUMENTS

| | | | |
|---|---|---|---|
| 1308716 | 5/1987 | U.S.S.R. | 37/58 |

*Primary Examiner*—Randolph A. Reese
*Assistant Examiner*—Arlen L. Olsen
*Attorney, Agent, or Firm*—James E. Nilles

[57] ABSTRACT

Dredging apparatus including a diver-operator controlled and hand-held dredge head which permits the diver to move about freely in the water bed being dredged, and provides for continuously dredging the mixture of water and solids from a first body of water and pumping the mixture to a second solids collecting body of water. Submersible, hydraulic dredge pumps are used in the bodies of water. The conveying water is continuously reused in a quasi-closed system by being returned to the immediate vicinity of the nozzle or alternatively being returned through a sleeve concentrically mounted around the nozzle. The returned water discharges downwardly to counterbalance the weight of the operator-held dredge. The second, solids collecting area may take the form of a truck body into which the solid material is dumped and the dredge water passes through into a filter tank from which it is pumped and returned to the dredge area for reuse in transporting additional solids. An improved diver-operated, hand-held dredge which includes a water return means that discharges downwardly in the area of the dredge nozzle so as to counterbalance the weight of the diver-operated hand-held dredge head.

13 Claims, 3 Drawing Sheets

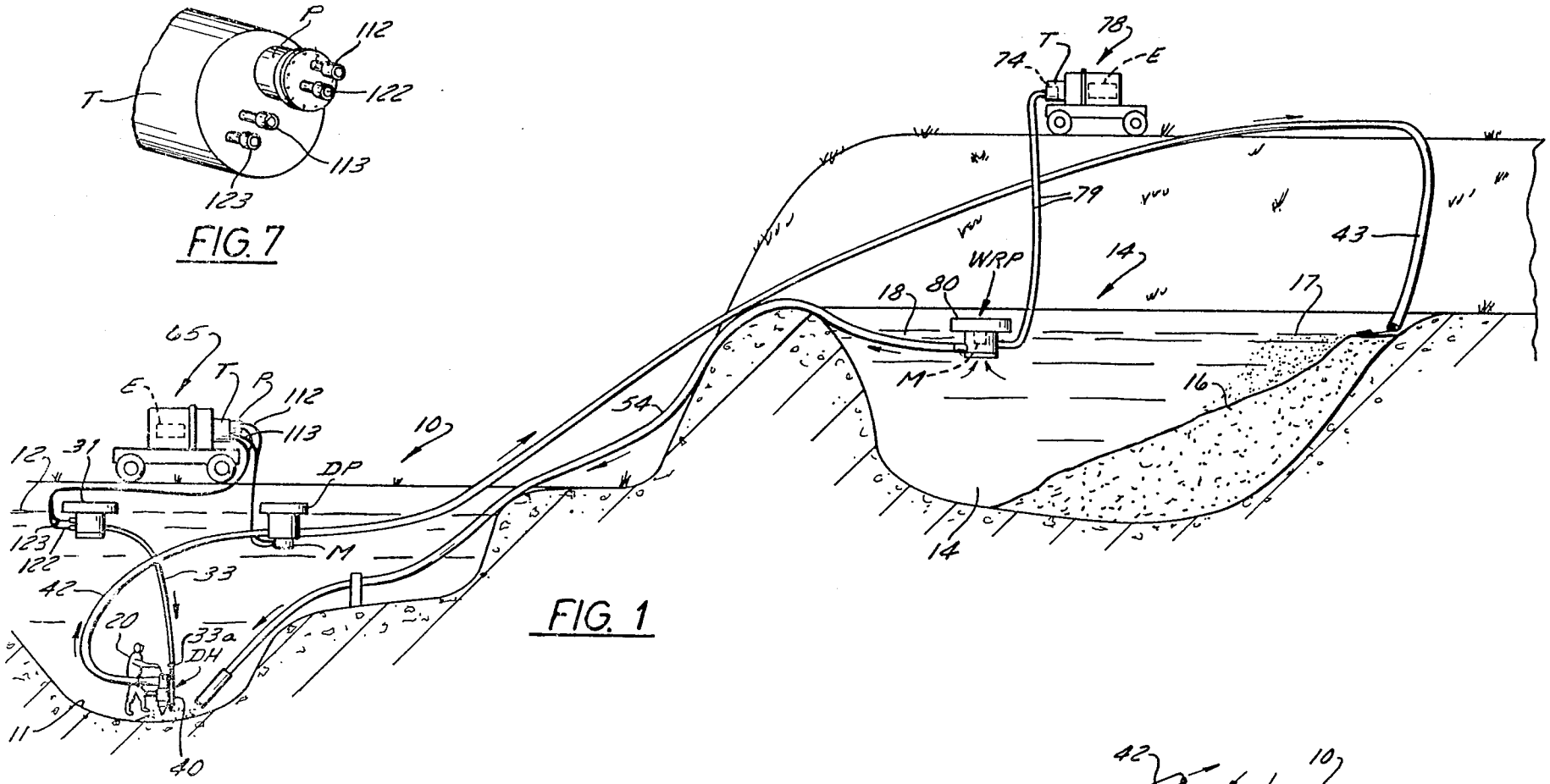
FIG. 1
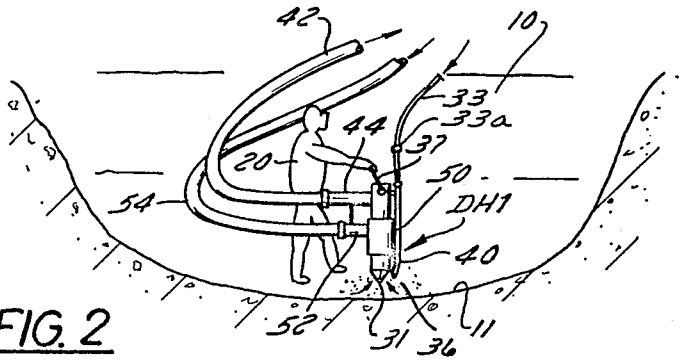
FIG. 2
FIG. 7

DREDGING APPARATUS HAVING A DIVER-OPERATED HAND-HELD DREDGE HEAD FOR QUASI-CLOSED LOOP SYSTEM

CROSS-REFERENCES TO A RELATED APPLICATION

This is a continuation-in-part application of the pending application Ser. No. 47,220, filed May 8, 1987 and which issued as U.S. Pat. No. 4,807,373 on Feb. 28, 1989.

BACKGROUND OF THE INVENTION

Related Art

Some of the apparatus of the present invention is in part in the nature of an improvement over that shown in U.S. Pat. No. 4,352,251 which issued Oct. 5, 1982 and is entitled "Hand Operated Suction Dredge Head and Hydraulic Submersible Pump Assembly".

SUMMARY OF THE INVENTION

The present invention provides dredging apparatus including a diver-operated, hand-held dredge head for continually using essentially the same water in a quasi-closed loop system for pumping a mixture of solids and water from a dredging area to a solids collecting area.

More specifically, the present invention provides apparatus of the above type and also including floating dredge pumps and a diver-operated manually operated dredge head, with a jet stirring or digging attachment, for continuously dredging a mixture of solids and water from a first dredging area of water, pumping the mixture from the dredging area and allowing the solids to settle out from the dredge water at a second body of water, and includes another water return pump for returning the relatively clear dredge water to the first body of water, and then reusing the dredge water to again convey more solids from the dredging area to said second body of water, thereby continually reusing and pumping the dredged water in a quasi-loop circuit to convey solids from the first dredging area to the second solids collecting area.

The above invention includes a hand operated, diver-operated dredge head having a jet digger and a suction nozzle for picking up the mixture at the first area of water and utilizing a water return pump for pumping the mixture to the second solids collecting area, and using another dredge pump for returning said relatively clear dredge water from the second area to the vicinity of the dredge head and discharging it adjacent said nozzle to thereby provide used water for picking up additional mixture by said nozzle.

A further more specific aspect of the invention includes apparatus of the above type including use of a mobile dump body as the second solids collecting body of water and the use of a removable filter tank within the dump body for withdrawing the separated dredge water through rom the filter tank and pumping the used water by means of a dredge pump in the filter tank and back to the first body of water.

Another more limited aspect of the invention provides apparatus for continuously dredging a mixture of solids and water from the first body of water and pumping it to one portion of a remote second body of water. The solids settle out of the mixture and meanwhile relatively clean water is pumped from adjacent the surface of another portion of the second body of water back to the first body of water where it is discharged well below the surface of the first body of water to thereby prevent foaming in the first body of water.

The above apparatus includes separate jet means (jet digger) for providing a jet of water which discharges adjacent the nozzle and which acts to stir up the material and facilitate its excavation.

A water return pump is floatingly located adjacent the surface of the second body of water for pumping relatively clear water from adjacent the surface of the second body of water and back to the first body of water where it is discharged below the surface of the first body of water.

Still, a more limited aspect of the invention relates to apparatus of the above type in which the returned water is routed through the dredge head which is working in the first body of water and the returned water is discharged under pressure downwardly and adjacent the nozzle of the dredge head to counterbalance the weight of the diver-operated dredge head nozzle.

The invention also provides a hand-operated dredge head for use by a diver and which head has a suction nozzle at its lower inlet end and also has an upper end for the entry of water into the dredge head; a tubular discharge branch extends from the nozzle and has a discharge end for connection to a suction pipe that conveys the material away from the dredge head and to a remote second body of water; a hand-operated valve permits the diver to adjust the position and vary the amount of water introduced into the nozzle to thereby vary the suction at the nozzle; and means are provided on the nozzle for receiving returned water from the remote body of water and discharging the returned water under pressure adjacent the inlet end of the dredge head to thereby counterbalance the weight of the nozzle. A more limited aspect of the invention relates to the said means being a sleeve which is concentrically mounted around the tubular nozzle and which provides an annular space into which the returned water is directed under pressure and from which space it is discharged adjacent the lower inlet end of the dredge head to counterbalance the weight of the diver held nozzle dredge head.

A more specific aspect of this invention also includes a deflector ring located on the dredge head adjacent the nozzle and for deflecting the returned water that issues under pressure from the annular space within the sleeve, thereby preventing the returned water from simply re-entering the inlet nozzle.

Another aspect of the invention relates to jetting means adjacent the nozzle for stirring up the water and material to be conveyed.

These and other objects and advantages of the present invention will appear hereinafter as this disclosure progresses, reference being had to the accompanying drawings.

BRIEF DESCRIPTION OF THE DRAWINGS

Fig. 1 is a generally schematic, vertical cross-sectional view through an area of the ground and showing a first body of water in which dredging is being accomplished and also showing a second body of water or spoil are to which the dredged material is delivered; the returned dredging water is discharged adjacent the dredge head;

FIG. 2 is a fragmentary view of a portion of the arrangement shown in FIG. 1 and which shows an alternate form of discharging the returned water, that is, to the hand-held dredge head for discharge immediately adjacent the nozzle pick-up; and also showing the jet digger;

FIG. 7 is a fragmentary, perspective view, on an enlarged scale and showing the end portion of the power units shown in FIGS. 1 and 6.

DESCRIPTION OF A PREFERRED EMBODIMENT

The present invention provides apparatus for carrying out a dredging operation from a first dredging area where it is necessary or desirable to return the relatively clean dredge water from a second solids collecting pond, filter pit, sand pit, dump body or other spoil area to which the mixture of solids and water has been pumped. In other words, for ecological or other reasons it is essential to not flood or pump excessive water into the second solids collecting spoil area.

The present invention permits the mixture of solids and water to be pumped to the second solids collecting area where the solids settle out from the mixture and the transport water is returned for additional transport of solids.

As shown in FIG. 1, while the pumping of the mixture and settling of the solids is taking place, the relatively clean dredge water is returned for reuse in conveying additional solids. That is, the relatively clean water which has risen to the top of the second body of water 14 is pumped off from the second body adjacent its surface, and this water is then returned to the first body of water 10 where the dredging takes place. The returned water is conducted to well below the surface of the body of water being dredged so that foaming, surface turgidity or other turbulence is avoided which, among other things, makes it difficult for good visibility of the diver. The returned water can simply be returned and dumped into the first body of water 10 adjacent the dredge head DH (FIG. 1).

Figure 3:
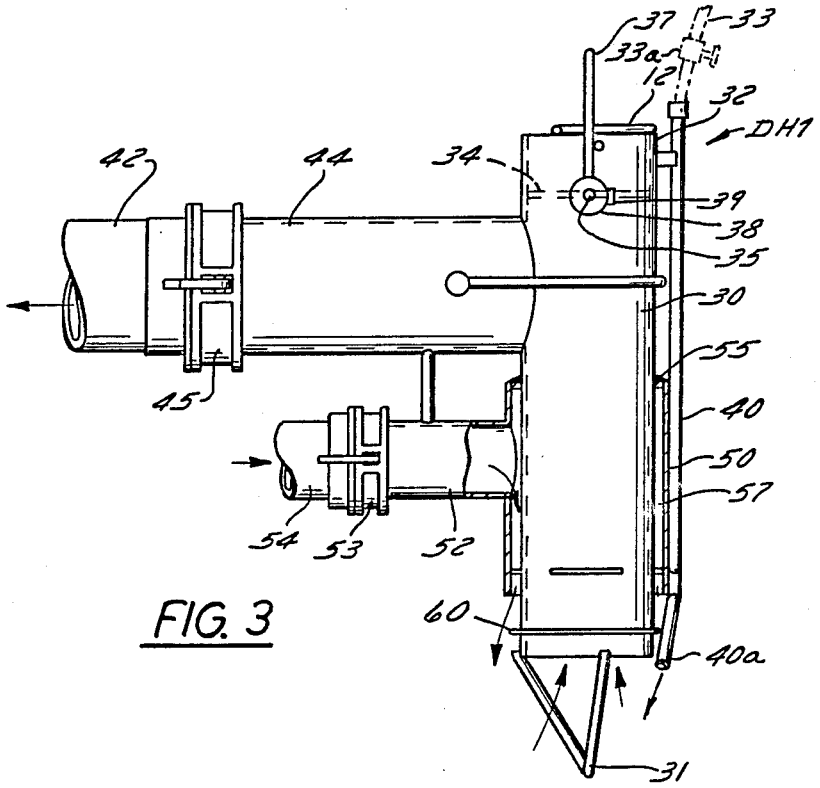
FIG. 3 is a side elevational view, partially in section, of the improved dredge head on an enlarged scale from the schematic showing of the head in FIG. 2.
Figure 4:
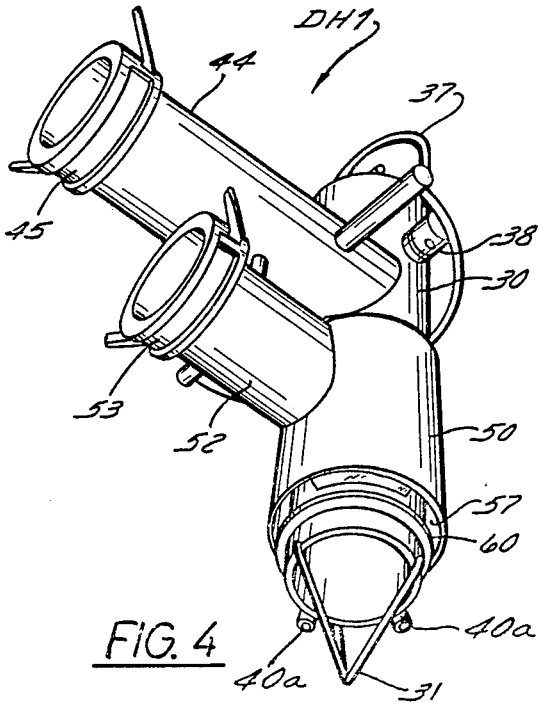
FIG. 4 is a perspective view taken generally from the inlet nozzle end of the dredge head shown in FIG. 3.

Alternatively, as shown in the FIG. 2 type of dredge head DH1, the water is returned through a sleeve 50 (FIGS. 2, 3, 4 and 6) and discharged around the end of hand-held dredge DH1 which is being operated by the diver 20. The return water is reused in transporting additional solids. The downwardly directed water that discharges from the sleeve 50 acts to counterbalance the weight of the dredge head to relieve some of the burden on the diver-operator. A deflector ring 60 (FIGS. 3 and 4) can be used around the dredge head adjacent the nozzle so that the returned water is deflected away from the immediate area of the inlet end of the nozzle so that it will not be simply picked up again by the inlet nozzle without picking up solids for transport.

Referring more specifically to the drawings (FIG. 1), the first dredging area, i.e., the body of water 10 which is being dredged has a bottom indicated generally at 11 in which the dredging takes place and which is located well below the surface 12 of the first body of water 10.

In the FIG. 1 embodiment, a second body of water 14 may be located a considerable distance from the first body of water and at such a location that excessive water cannot be accumulated in that remote area. As an example, the solid material 16, such as sand, and which has been dredged from the first body of water 10 is located generally at one portion 17 of the second body of water 14, for example, as shown to the right in FIG. 1. Thus, the solid material 16 collects at portion 17 of the second body of water while another remote portion 18 of the body of water 14 is of relatively clean or clear consistency.

The dredge head DH1 of the present invention (as shown in FIGS. 2, 3, 4 and 6) is in the nature of an improvement over the dredge head shown in the said U.S. Pat. No. 4,352,251, the latter of which has proved to be particularly successful in commercial operation. If a detailed description of the dredge head is deemed to be either necessary or desirable, reference may be had to the said patent. For the purposes of the present description (as shown clearly in FIGS. 3, and 4), the dredge head is preferably made of an aluminum alloy and is portable by the diver-operator 20, it is compact and relatively small and has all of its parts within easy reach of the operator. The dredge head includes the elongated tubular suction nozzle 30 having a lower end to which is welded or otherwise secured a shield or grill 31 fabricated from aluminum alloy rods. This grill prevents relatively large material such as rocks, cans or other foreign material from entering the dredge head. The upper or opposite end of the tubular section nozzle is relatively open except for the rods 12 welded thereacross which prevent inadvertent entry of material therein. Adjacent the upper end 32 of the suction nozzle 30 is a circular plate, butterfly type valve 34, fixed to and oscillatably mounted on its shaft 35. A U-shaped operator's handle 37 is fixed to the shaft 35 by bolts 39 extending through the cup-shaped members 38 that in turn are welded to the handle. The valve is swingable to any one of a number of adjusted positions between a closed position where it prevents water from entering the upper end of the nozzle to a fully open position where water can freely enter the upper end of the nozzle due to the suction in the conduit 42. Suction for the nozzle is supplied by a floating dredge pump DP which floats adjacent the surface 12 of body of water 10.

Figure 6:
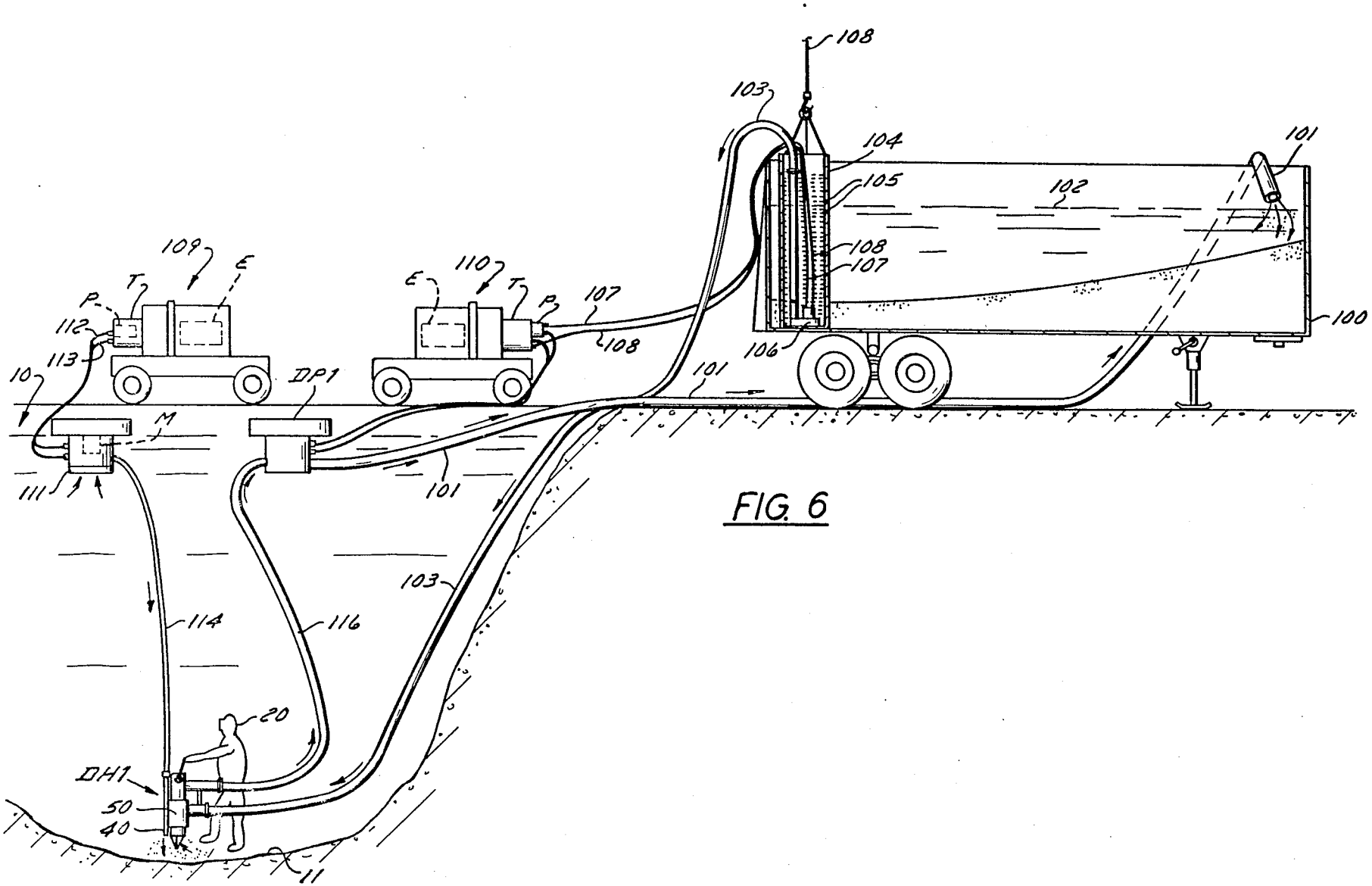
FIG. 6 is another generally schematic, vertical cross-sectional view through the first area being dredged and also showing the solids collecting area as a mobile dump body having a removable filter.

A jet digger attachment 40 (FIGS. 1, 2 and 3) is provided on the nozzle and has discharge ends **40*a* (FIGS. 3 and 4) through which water under pressure is discharged from a dredge pump 31 (FIG. 1) via conduit 33 into the area being dredged to thereby stir up and agitate the material to be pumped and facilitate its excavation. A similar jet digger is shown in FIG. 6. Thus, the pressurized water pipe 33 furnishes the water to the jet digger attachment 40 and a valve 33*a*** is provided for operator adjustment of the flow. For instance, this "jet fluid" is provided at a pressure of 90–150 p.s.i. for example, which is required for working with hard mud. This jet digger attachment can also be used to regulate the agressiveness of the nozzle by counterbalancing the downward thrust of the nozzle, also rendering the nozzle easy to control by the operator.

The dredge head DH1 of FIG. 2 also includes a tubular discharge branch 44 (FIGS. 3 and 4) which is welded to the tubular suction nozzle 30 intermediate the length of the latter and is thereby in fluid communication therewith. The rear or discharge end of the branch 44 is secured to the inlet end of the suction conduit 42 by means of a conventional swivel coupling 45. Coupling 45 provides a swivel connection between the dredge head and the suction conduit so the head can be rotated relative to the conduit by the operator to an suitable position.

Thus, the improved dredge head utilizes water which is returned via conduit 54 from the second body of water 14 (FIG. 1) and to the vicinity immediately adjacent the nozzle 30, where it can be reused to convey additional solids.

In FIGS. 2, 3, 4 and 6, the water return means takes the form of the previously mentioned sleeve 50 concentrically mounted around the tubular nozzle 30 and having a laterally extending conduit 52 for receiving returned water from the remote body of water. Conduit 52 has a swivel joint connection 53 for connection with the returned water conduit 54 in FIG. 2. The upper end of the sleeve 50 is closed by being welded as at 55 (FIG. 3) to the dredge head 30. The sleeve 50 and dredge head nozzle 30 form an annular space 57 or chamber therebetween. The cross-sectional area of the annular space 57 is equal to or greater than the cross-sectional area of conduit 52. The lower end of the sleeve 50 is open (FIG. 4) for discharging water under pressure downwardly and towards the lower end of the nozzle to thereby deliver the returned water adjacent the nozzle for reuse in transporting additional solid material. It may be desirable to deflect the returned water somewhat away from the inlet end of the nozzle so that the water is not simply again sucked up and pumped to the remote second body of water 14. For this purpose, the previously mentioned deflector ring 60 is welded and located around the periphery of the nozzle 30 and spaced slightly from the discharge end of the returned water sleeve 50. Ring 60 acts to deflect the water, as it is discharged from the sleeve, away from the nozzle, as indicated by the arrows in FIG. 3.

The mixture of material being dredged is conveyed by the conduit 42 (FIG. 1) where it discharges at that end 43 of the conduit located at the said one portion 17, that is, off to one side of the second body of water 14, and as indicated at the right side of FIG. 1.

The previously mentioned dredge pump DP (FIG. 1) provided for the dredge head DH has the dredge power source unit 65 located on the shore. The power unit 65 may take the form as shown and described in the U.S. Pat. Nos. 3,910,728, issued Oct. 7, 1975; 4,352,251 of Oct. 5, 1982; 3,957,402 of May 18, 1976; 3,957,403 of May 18, 1976; 4,390,305 of June 28, 1983 or 4,515,517 of May 7, 1985.

Generally, the power units to be referred to, that is, power units 65 and 78 (FIG. 1) and 109 and 110 (FIG. 6) are similar to one another and are mobile and driven, for example, by their internal combustion engines E. Conventionally, they include a pressure fluid pump P driven by their engine E for supplying pressurized fluid which is directed to and returned from their respective dredge pump by suitable flexible pressure fluid conduits.

One power unit, such as 65 of FIG. 1 or 110 of FIG. 6, may service more than one dredge pump, depending on the location thereof which may vary depending on the terrain. As shown in FIG. 1, as shown, for example, with power unit 65, the pressure fluid conduit 112 conducts pressure fluid from the engine driven pressure pump P to the fluid motor M of the dredge pump DP; conduit 113 returns the pressure fluid from the motor M of the dredge pump to the tank T. A second pair of similar conduits 122 and 123 (FIG. 7) are provided for dredge pump 31.

The power units 78 and 109 only service one dredge pump and in that case only one of their pairs of pressure fluid conduits is used and the other pair is capped.

Figure 5:
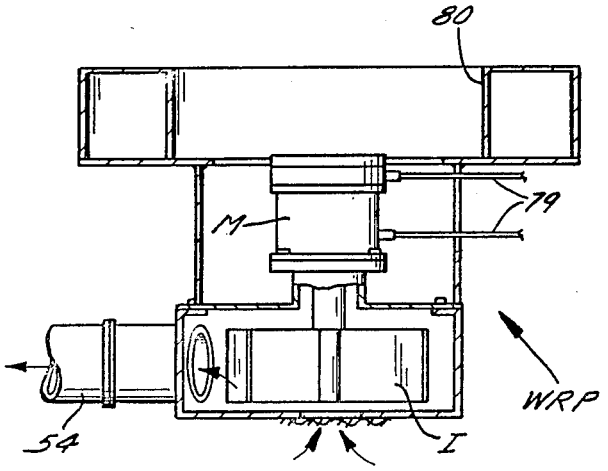
FIG. 5 is a cross-sectional view of the floating hydraulic submersible pumps as shown in FIGS. 1 and 6 on an enlarged scale.

The means for returning the relatively clean water from adjacent the surface of the second body of water 14 to the first body of water 12 may in some installations be located a considerable distance away from power source 65. The water return means includes a water return pump WRP (FIGS. 1 and 5) which has a chamber or buoyant means 80 for floatingly suspending it adjacent the surface of the second body of water 14. This pump WRP is located at another portion 18 of the second body of water 14 which is spaced away from portion 17. The pump WRP may be of that type shown in FIG. 6 of U.S. Pat. No. 4,352,251 and includes an impeller I driven by that hydraulic motor M (FIG. 5) from a fluid pump 74 which is driven by a power unit 78 located on shore and connected thereto by pressure fluid conduits 79. Power unit 78 also has an internal combustion engine E and fluid tank T of conventional character. Thus, the floating pump WRP continuously returns relatively clean water via conduit 54 from adjacent the surface 18 of the second body of water and back to the area being dredged, more specifically, immediately adjacent the nozzle 30.

FIG. 6

The embodiment of the invention shown in FIG. 6 utilizes a dump body 100 such as a mobile dump body that can be moved by a truck tractor (not shown). In this embodiment the discharge line 101 for the mixture discharges from floating dredge pump DP1 into the dump body where the solids settle out at the bottom of the body.

The water level 102 in the truck is such that the slotted filter tank 104 is located within that body of water. The size of the slots 105 in the cylindrical filter tank 104 is preferably about 0.020 of an inch in width which is of a size sufficient to permit rapid passing of water therethrough, but at the same time remove substantially all of the solid material at a rapid rate. These slots can preferably be formed by sawing, the pipe itself preferably being made from the conventional PVC plastic material.

The relatively clean dredge water return line 103 receives the water pumped from the filter tank 104 by means of the fluid pump 106 located at the bottom of the dump body, i.e., within the filter tank 104, and thus the return dredge water is pumped back to the dredging area of water, i.e., to the sleeve 50 of dredge head DH1. Pump 106 may be of the conventional type known as a trash pump or other submersible hydraulic dredge pump and is driven by the hydraulic fluid in line 107 from the fluid pressure pump P of the power unit 110; line 108 returns the fluid to the tank T.

Power unit 109 provides pressure fluid to and from floating dredge pump 111 via conduit 112 and 113. Pump 111 pumps water via conduit 114 to the jet digger 40 of dredge head DH1. Conduit 116 conveys the mixture to dredge pump DP1 which pumps it via conduit 101 to dump body 100.

It should be noted that the filter tank 104 can be lifted from the dump body by means of a cable 108 and a crane, for example, not shown. The body 100 can then be transported for the dumping of its load of solids elsewhere.

Recapitulation

The present invention provides an improved dredging apparatus including a diver-operator controlled and hand-held dredge head which permits the diver to move about freely in the water bed being dredged. The apparatus provides for continuously dredging the mixture of water and solids from a first area and pumping the mixture to a second solids collecting area. Then, the conveying or transport water is continuously reused in the quasi closed circuit of the present invention by being returned to the immediate vicinity of the nozzle or alternatively being returned through a sleeve concentrically mounted around the nozzle and which then discharges the water downwardly to counterbalance the weight of the operator-held dredge.

In one embodiment the invention shown in FIG. 6, the second, solids collecting area takes the form of a truck body into which the solid material is dumped and then the dredge water is filtered through and into a filter tank where it is pumped out therefrom and returned to the dredge area for reuse.

The invention also provides an improved diver-operated, hand-held dredge which includes a water return means that discharges downwardly in the area of the dredge nozzle so as to counterbalance the weight of the diver-operated hand-held dredge head.

What is claimed as the invention is:

1. Dredging apparatus forming a dredging quasi-closed loop circuit comprising:

a diver-operator controlled hand-held dredge head having a tubular suction nozzle for continuously dredging a mixture of solids and water from adjacent the bottom of a first body of water, a hydraulic motor driven dredge pump floating adjacent the surface of said first body of water, a suction conduit connected to said dredge head for sucking said mixture therefrom, a pressurized fluid power source located on shore and connected to said dredge pump hydraulic motor for pumping said mixture from said head and said first body of water and to a second, separate body of water which is spaced a distance from said first body of water and for depositing and allowing the solids to settle out from the mixture at one portion of said second body of water;

a hydraulically driven water return pump located in said second body of water and spaced from said one portion of said second body of water to thereby pump relatively clear water from said second body of water, a return water pressurized fluid power source located on shore and connected to said water return pump for driving the latter, said water return pump having a return water conduit for returning relatively clear water from said second body of water and to the hand held dredge head nozzle in said first body of water, whereby the returned dredge water is again used to convey more solids from said first body of water to said second body of water, thereby continually reusing and pumping the dredged water in a loop circuit to convey solids from the first body of water to said second body of water.

2. The apparatus as described in claim 1 further characterized in that said dredge head tubular suction nozzle has a lower inlet end and an open upper end for the entry of water therein, a tubular discharge branch extending from said nozzle and at a point intermediate the length of said tubular nozzle, said tubular branch having a discharge end for connection to said suction conduit for conveying the excavated mixture away from said head and to said second, separate body of water, a hand operated valve pivotally mounted in said nozzle adjacent its upper end for permitting the diver operator to move said valve to any adjusted position between a closed position and an open position and for thereby varying the amount of water introduced through said valve and into said nozzle to thereby vary the suction at said lower inlet end of said nozzle.

3. The apparatus set forth in claim 2, including a sleeve concentrically mounted on said tubular nozzle and having means for receiving said returned water from said second body of water, said sleeve having an open lower end for discharging said returned water under pressure downwardly and adjacent said lower inlet to thereby counterbalance the weight of the dredge heads.

4. The apparatus set forth in claim 3 further characterized in that said dredge head includes a jetting digger attachment with a discharge end adjacent the area being dredged to thereby stir up and agitate the solids to be excavated, a second pump in said first body of water for supplying pressurized water to said attachment, and means for driving said second pump.

5. The apparatus of claim 1 further characterized in that said second separate body of water is in a mobile dump body, said body having a removable filter tank therein, said tank formed by an upstanding pipe having a series of slots cut therein to act as a filter for permitting substantially only water to pass into said filter tank, said water return pump is a submergible hydraulic dredge pump located in said filter tank and having a discharge conduit connected thereto and extending to said hand-held dredge for pumping relatively clear water from said filter tank and back to the interior of said dredge head for being reused to convey additional solids picked up by said head to said mobile dump body.

6. The apparatus described in claim 5 including means for lifting said removable filter tank and water return pump from said dump body to permit transport and dumping of said body at a remote location.

7. A hand operated dredge head for being held by a diver operator for underwater excavating, comprising, a tubular suction nozzle having a lower inlet end and an open upper end for the entry of water therein, a tubular discharge branch extending from said nozzle and at a point intermediate the length of said tubular nozzle, said tubular branch having a discharge end for connection to a suction pipe for conveying excavated material away from said head, a hand operated valve pivotally mounted in said nozzle adjacent its upper end for permitting the diver operator to move said valve to any adjusted position between a closed position and an open position and for thereby varying the amount of water introduced through said valve and into said nozzle to thereby vary the suction at said lower inlet end of said nozzle, and return water receiving means mounted on said tubular nozzle for receiving returned water from a remote location and discharging it under pressure adjacent said lower inlet and in a downward direction to thereby counterbalance the weight of the diver held nozzle dredge head.

8. The dredge head as described in claim 7 including a water deflector mounted on said dredge head and adjacent said lower inlet end of said nozzle and also located adjacent the discharge of said open end of said sleeve for deflecting water away from said nozzle as it is discharged from said sleeve.

9. A portable, lightweight, hand operated dredge head and for being held by the arms of a diver operator for underwater excavating, comprising, a tubular suction nozzle having a lower inlet end and an open upper end for the entry of water therein, a tubular discharge branch extending from said nozzle and at a point intermediate the length of said tubular nozzle, said tubular branch having a discharge end for connection to a suction pipe for conveying excavated material away from said head, swivel coupling means between s id discharge end of said branch and said suction pipe whereby said head can be rotationally swivelled relative to said suction pipe and quickly detachably connected thereto, a hand operated valve pivotally mounted in said nozzle adjacent its upper end, an operator's handle secured to said valve and extending from said nozzle for permitting the diver operator to move said valve to any adjusted position between a closed position and an open position and for thereby varying the amount of water introduced through said valve and into said nozzle to thereby vary the suction at said lower inlet end of said nozzle, and a sleeve concentrically mounted on said tubular nozzle and having means for receiving returned water from a remote location, said sleeve having an open lower end for discharging said returned water under pressure adjacent said lower inlet and in a downward direction to thereby counterbalance the weight of the diver held nozzle dredge head.

10. The dredge head as described in claim 9 including a water deflector mounted on said dredge head and adjacent said lower inlet end of said nozzle and also located at the discharge of said return water receiving means for deflecting water away from said nozzle as it is discharged from said water receiving means.

11. Apparatus for pumping and receiving a mixture of solids and water from a body of water, said apparatus including:

means for pumping said mixture of solids and water from said body of water into a mobile truck dump body, said mobile truck dump body having ground wheels and forming a solid-collecting area, said body having a removable filter tank therein, said tank formed by an upstanding pipe having a series pf slots cut therein to act as a filter for permitting substantially only water to pass into said filter;

a submergible hydraulic dredge pump located in said filter tank and having a discharge conduit connected thereto for pumping relatively clear water from said filter tank;

and means for lifting said removable filter tank from said dump body for enabling said dump body to be emptied of the solids accumulated therein.

12. The apparatus set forth in claim 11 further charatterized in that said upstanding pipe is formed pf PVC plastic material and said series of slots therein are about 0.020 of an inch in width which permit rapid passing of water therethrough but at the same time removes substantially all of the solids.

13. Apparatus for use in a dredging system to pump, receive, process and dispose of material dredged from beneath a body of water, said material comprising a mixture of water and solids, said apparatus comprising:

means for pumping said mixture of solids and water from said body of water into a mobile land vehicle body for receiving said mixture;

filter means removably mounted in said body and operable when mounted therein to remove substantially all water from said mixture in said body and thereby leave a residue comprised substantially of said solid material;

means operable to effect removal of said residue from said body; and a submergible hydraulic dredge pump located in said filter means and having a discharge conduit connected thereto for pumpimg relatively clear water from said filter means.

* * * * *